US005965978A

United States Patent [19]

Kishino et al.

[11] Patent Number: 5,965,978

[45] Date of Patent: Oct. 12, 1999

[54] FIELD EMISSION DISPLAY DEVICE WITH IMPROVED DIELECTRIC BREAKDOWN CHARACTERISTIC

[75] Inventors: Takao Kishino; Haruhisa Hirakawa; Kenichi Furumata, all of Mobara, Japan

[73] Assignee: Futaba Denshi Kogyo K.K., Mobara, Japan

[21] Appl. No.: 08/893,187

[22] Filed: Jul. 15, 1997

[30] Foreign Application Priority Data

Jul. 16, 1996 [JP] Japan ..... 8-186184

[51] Int. Cl.[6] ..... H01J 63/04

[52] U.S. Cl. ..... 313/496; 313/493; 313/495

[58] Field of Search ..... 313/493, 495, 313/496, 318.01, 318.12; 439/824

[56] References Cited

U.S. PATENT DOCUMENTS 4,149,105 4/1979 Hirooka et al. ..... 313/496
4,767,965 8/1988 Yamano et al. ..... 313/493
5,463,276 10/1995 Kawasaki et al. ..... 313/496
5,621,272 4/1997 Levine et al. ..... 313/422
5,635,795 6/1997 Itoh et al. ..... 313/496
5,734,224 3/1998 Tagawa et al. ..... 313/495

*Primary Examiner*—Vip Patel
*Assistant Examiner*—Matthew J. Gerike
*Attorney, Agent, or Firm*—Oblon, Spivak, McClelland, Maier & Neustadt, P.C.

[57] ABSTRACT

A field emission type display device including a container formed of an anode substrate, a cathode substrate and side wall portions, and a cover member mounted at the container to form a getter room. An anode lead is securely fixed on the cover member so as to be derived outward from the outer wall confronting the anode substrate. Two wires are attached to the front end of the anode lead. When the cover member is mounted on the container, the curved portions of the two wires is pressed against the anode terminal formed on the anode substrate extended to the end of the anode substrate to secure electric conduction between the anode terminal and the anode lead. This structure provides easy-to-use anode leads which can be simply derived as electrodes.

4 Claims, 9 Drawing Sheets

FIELD EMISSION DISPLAY DEVICE WITH IMPROVED DIELECTRIC BREAKDOWN CHARACTERISTIC

BACKGROUND OF THE INVENTION (1) Field of the Invention

This invention relates to a field emission type display device including field emission elements acting as electron sources inside a thin container and a getter room formed adjacent to the thin container.

(2) Description of the Related Art

A field emission type display device (panel) having field emission elements as electron sources (hereinafter sometimes referred to as FED) has been known as a fluorescent display tube of which the thin container contains field emission elements acting as electron sources.

FIGS. 9(*a*) and 9(*b*) partially illustrate the configuration of a container for that type of FED. In the field emission type display device shown in FIG. 9(*b*), the anode substrate 54 has the display portion 53 formed of the fluorescent material layer 51 and the metal-backed layer 52. The cathode substrate 56 has the inner surface on which the field emission elements 55 are formed so as to confront the display portion 52 formed on the anode substrate 54. The container 27 is formed by hermetically sealing the anode substrate 54 and the cathode substrate 56 at the peripheral portions thereof, with the substrates spaced from each other a predetermined distance.

In the FED, the anode substrate 54 and the cathode substrate 56 are formed of a thin glass plate, respectively. The gap between the substrates 54 and 56 is very narrow.

In order to function the FED as a display device, the inside of the container must be maintained a high vacuum degree such that the field emission element 55 can effectively emit electrons.

However, since the container 57 of the FED is very thin, the getter member that adsorbs gas produced in the container 57 cannot be placed inside the container 57. A getter room, as shown in FIG. 9(*a*), is additionally formed by assembling a box-like cover member 58 on the outside of the container 57. A getter film is formed by evaporating the getter in the getter room.

In the above-mentioned FED, since electrons emitted from the field emission element 55 onto the fluorescent material layer 51 radiate light, a metal-backed layer 52 of a conductive material such as aluminum is deposited so as to cover the whole surface of each of dot-like fluorescent material layers 51. Moreover, as shown in FIG. 9(*a*), a part of the metal-backed layer 52 is derived to the end portion of the anode substrate 54 to form the anode electrode 59. An additional electrode is formed to the anode terminal 59 to connect electrically to the drive circuit.

In the FED of the type which has an anode electrode to which a high anode voltage of, for example, 2 to 10 kV is applied, it is needed to secure safety, easy-to-connection, and mass-productivity when the conductor acting as an anode derived from the display portion 53 is electrically connected to an external drive circuit.

In the above-mentioned conventional FED, the anode substrate 54 and the cathode substrate 56, as shown in FIG. 9(*a*), must be arranged so as to be shifted somewhat in plane to apply an anode voltage on the metal back layer 52 coated over the fluorescent material layer 51. Moreover, the anode electrode 59 must be placed so as to drive a part of the metal-backed layer 52 toward the outside of the container 57. Additional electrode must be arranged to connect the anode terminal 59 to the drive circuit.

However, since the metal-backed layer 52 coated on the fluorescent material layer 51 is formed in close contact with the surface of the anode substrate 54, together with the anode terminal 59, it is difficult to connect easily the electrode to the anode thermal 59. Moreover, the high voltage applied may cause a decrease in safety because of the difficulty in connection.

Usually, the anode substrate 54 and the cathode substrate 56 are hermetically fixed with a sealing agent filled in the spaces between the peripheral portions of them. This sealing agent has a dielectric strength lower than that of the substrates 54 and 56. The anode electrode 59 formed as a part of the metal-backed layer 52 or formed differently from the metal-backed layer 52 and electrically connected to each other is derived to the end portion of the anode substrate 54 in contact with the sealing agent.

However, when a high anode voltage is applied to the metal-backed layer via the additionally-formed electrode, the sealing agent may result in its dielectric breakdown because of the short distance between the substrates 54 and 56. The dielectric breakdown of the sealing agent may cause undesired current rushing into other components such as the cathode substrate 56 confronting the anode substrate 54 and field emission elements formed on the cathode substrate 56. As a result, the problem that the FED is not normally glowed arises.

SUMMARY OF THE INVENTION

It is the object of the invention is to provide a field emission type display device having improved dielectric strength characteristics that can provide an anode lead easily handled and simply derived as an electrode, and easily derived from an anode terminal through no hermetically-sealed portions.

In order to accomplish the above-mentioned object, a field emission type display device comprises an anode substrate including display portions each formed of a fluorescent material layer and an anode conductor; a cathode substrate having an inner surface on which electron emission elements are formed so as to confront the display portion of the anode substrate; wherein a container is formed by spacing the anode substrate and the cathode substrate from each other a predetermined distance and hermetically sealing peripheral portions of the cathode substrate and the anode substrate using a sealing agent; the container having an exhaust hole formed in a part of the peripheral portion of the container; a cover member securely mounted to an outside of the container so as to form a getter room communicating with the exhaust hole; and an anode lead being in contact with an anode terminal forming a portion of the anode conductor derived to the end portion of the anode substrate and externally extended from a portion of the wall surface of the cover member and hermetically mounted to the cover member.

The anode terminal is derived to the end portion of the anode substrate through the exhaust hole of the container.

The front end of the anode lead has a resilient characteristic to press against the anode terminal.

The anode lead comprises a leaf spring member and is externally derived from the cover member through a sealing portion formed between the cathode substrate and the cover member.

The anode lead is externally derived from the cover member through the exhaust tube attached on the cover member forming the getter room.

In the field emission type display device according to the present invention, an anode lead is securely fixed to a cover member forming a getter room attached to the outside of the container while it extends externally from a part of the wall portion of the cover member. With the cover member securely fixed to the container, the front end of the anode lead is pressed against the anode terminal derived from the end of the anode substrate for electrical contact, so that electrical conduction is accomplished between the anode terminal and the anode lead.

The above and other objects, features and advantages of the present invention will become apparent from the following description when taken in conjunction with the accompanying drawings which illustrate preferred embodiments of the present invention by way of example.

BRIEF DESCRIPTION OF THE DRAWINGS

FIG. 1(*b*) is an enlarged cross-sectional view partially showing the internal configuration of the container shown in FIG. 1(*a*);

FIG. 4(*b*) is a diagram partially showing a modified contact member for a field emission type display device according to the present invention;

FIG. 7(*b*) is an enlarged cross-sectional view partially showing the structure in which the cover member is assembled to the field emission type display device, according to a fourth embodiment of the present invention;

FIG. 9(*b*) is an enlarged side cross-sectional view partially showing the conventional field emission type display device.

DETAILED DESCRIPTION OF THE PREFERRED EMBODIMENTS

The embodiments according to the present invention will now be described below with reference to the attached drawings.

Figure 1A:
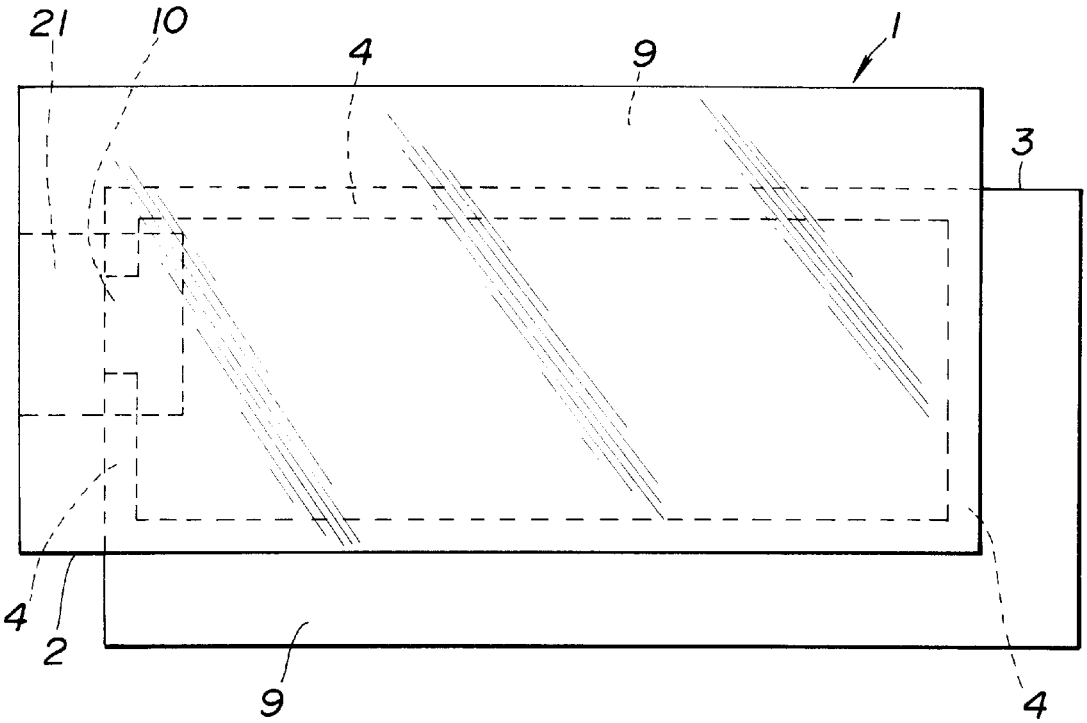
FIG. 1(*a*) is a plan view showing the container of a field emission type display device according to the present invention.
Figure 1B:
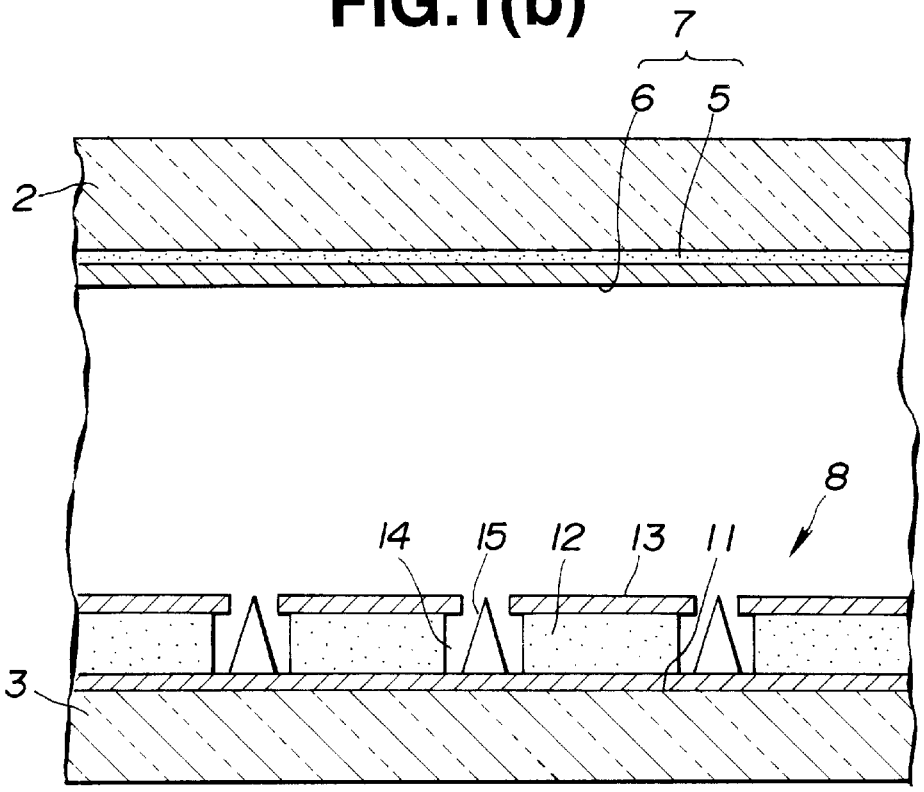
Figure 2:
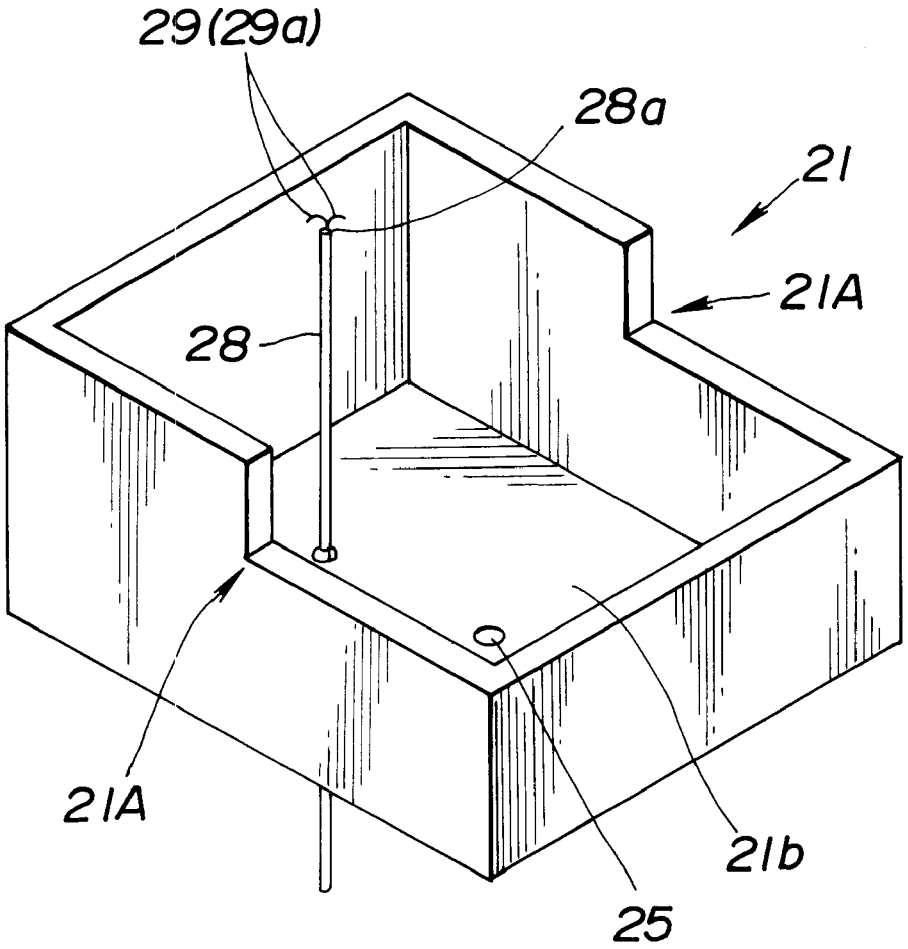
FIG. 2 is a perspective view showing a cover member to be assembled to a field emission type display device according a first embodiment of the present invention.
Figure 3:
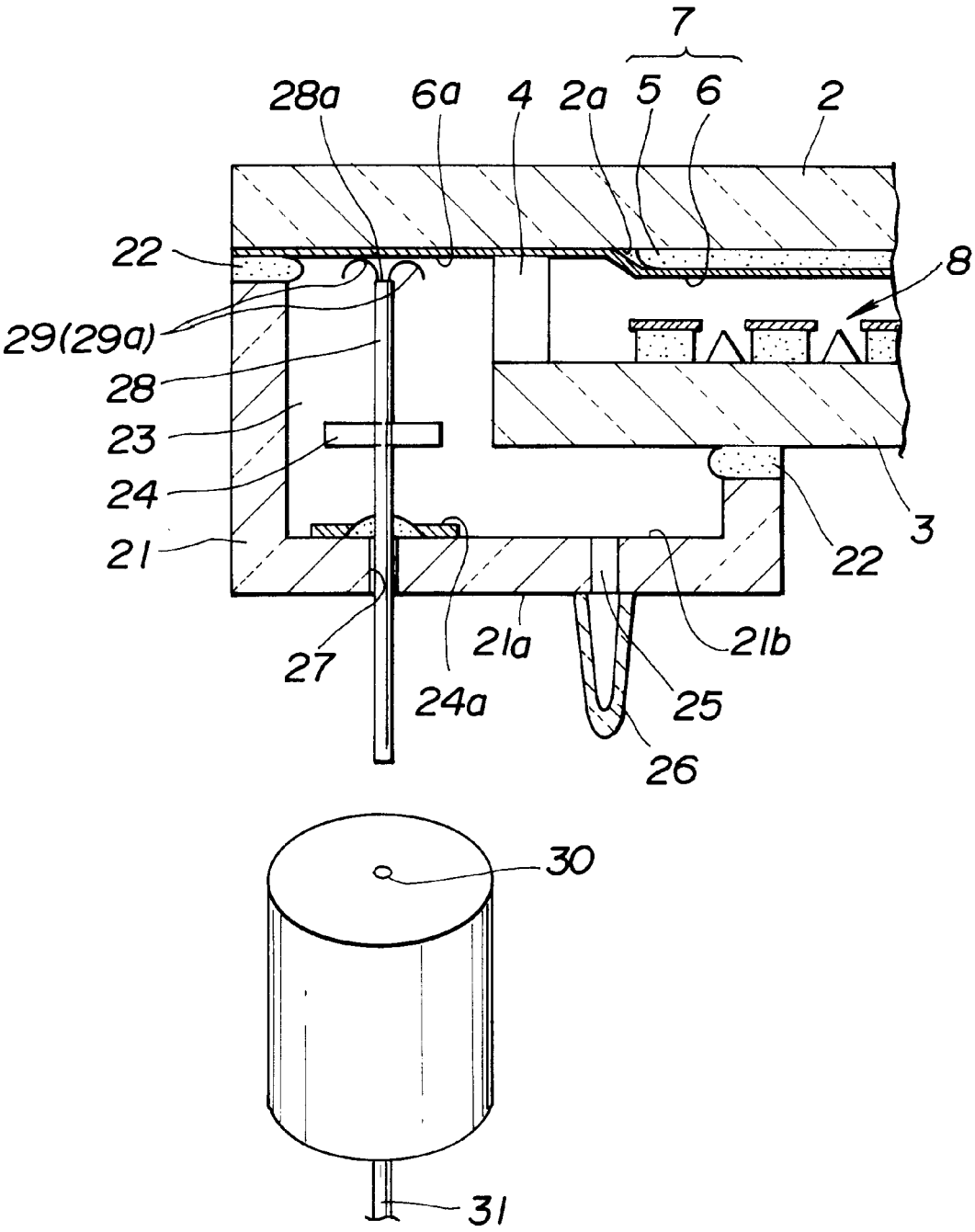
FIG. 3 is an enlarged cross-sectional view partially showing the structure in which the cover member shown in FIG. 2 is assembled to the field emission type display device.

FIG. 1(*a*) is a plan view showing the container of a field emission type display device according to the present invention. FIG. 1(*b*) is an enlarged cross-sectional view showing partially the internal configuration of the container shown in FIG. 1(*a*). FIG. 2 is a perspective view showing a cover member according to a first embodiment of the present invention. FIG. 3 is an enlarged cross-sectional view partially showing the cover member mounted on the field emission type display device, according to the present invention.

In the field emission type display device according to each of embodiment to be described below, the container 1 consists of an anode substrate 2, a cathode substrate 3 spaced from the anode substrate 2 a predetermined distance so as to confront each other, and a side wall portion 4 sandwiched between said substrates 2 and 3 and forming the sides of the container 1. The container 1 is of a flat type. The gap between the substrates 2 and 3, for example, is set to less than 2 mm.

The anode substrate 2 is preferably formed of a rectangular transparent insulating plate. A fluorescent material layer 5 and a metal-backed layer 6 acting as an anode conductor are coated over the inner surface of the anode substrate 2. The combination of the florescent material layer 5 and the metal back layer 6 forms the display portion 7 acting as an anode.

The cathode substrate 3 is formed of an insulating plate similar to that of the anode substrate 2. Field emission elements 8 are formed on the inner surface of the cathode substrate 3. The anode substrate 2 and the cathode substrate 3 are placed to be shifted somewhat in plane as shown in FIG. 1(*a*). Each substrate has the asymmetrical portion 9 where the substrates 2 and 3 do not confront each other.

The side wall portion 4 is made of a low-melting glass having a softening temperature of about 400° C. The side wall portion 4 is placed so as to surround the area where the anode substrate 2 and the cathode substrate 3 confront each other and to be sandwiched between the substrates 2 and 3. The side wall portion 4 is hermetically bonded together with the substrates 2 and 3. Thus, the display portion 7 and the field emission elements are housed in the thin boxlike container 1.

Let us now explain the internal configuration of the container 1 with reference to FIG. 1(*b*). The side wall portion 4 of the container 1 is partially cut away to form an exhaust hole 10 communicated with the inside of the container 1. In the container 1, vertical field emission elements 8 acting as electric sources of the display portion 7 are formed on the inner surface of the cathode substrate 3 confronting the anode substrate 2.

The field emission element 8 includes a cathode electrode 11 formed on the inner surface of the cathode substrate 3, insulating layers 12 such as silicon dioxide formed on the cathode electrode 11, gate electrodes 13 formed on the insulating layers 12, and corn emitters 15 formed on the cathode electrode 11 in holes formed through the insulating layer 12 and the gate electrode 13. In some field emission type display devices, a resistance layer is formed between the cathode electrode 11 and the insulating layer 12.

Fluorescent material layers 5 are coated in dot pattern on the inner surface of the anode substrate 2 in the container 1 and at the positions where the field emission elements 8 confront. The thin-film metal-backed layer 6 being a conductive metal such as aluminum are coated all over the fluorescent material layer 5. A part of the metal back layer 6 is derived to the end portion of the anode substrate 2 via the exhaust hole 10 in the container 1 and acts as an anode electrode.

The anode electrodes and the gate electrodes 13 in the field emission element 8 are arranged in a matrix pattern. The fluorescent material layers 8 coated on the anode substrate 2 are formed in the container 1. Thus, the confronting fluorescent material layers 8 can be selectively glowed which are positioned at the positions where the cathode electrodes 11 and the gate electrodes 13 intersect.

A drive circuit (not shown), which is connected to the anode lead 28 fixed on the cover member 21 (to be described later), supplies a voltage of 2 to 10 kV to the anode terminal 6*a* extending from the metal-backed layer 6.

In this field emission type display device, when the field emission element 8 emits electrons, the electrons hit the fluorescent material layer 5 via the metal-backed layer 6 acting as an anode electrode, thus causing excited luminescence. At this time, the radiated light can be observed through the transparent anode substrate 2.

As shown in FIG. 3, the cover member 21 is hermetically fixed at the outside of the container 1 and near to the exhaust hole 10. The cover member 21, as shown in FIG. 2, is formed of a boxlike glass member and is securely fixed on the outside of the container 1. Like the side wall portion 4, a low-melting glass having a softening temperature of, for example, about 400° C. is used as the fixing substance 22. The cover member 21 forms the getter room 23 which is communicated with the exhaust hole 10 and acts as a closed exhaust room. The getter 24 is placed within the cover member 21.

An adsorbent, which effectively adsorbs gas such as $CO_2$, CO, $H_2O$ released in the container 1 when the container 1 is assembled in the oven heating step in a container assembling process or when electrons hit the fluorescent material layer 5, is preferable as the getter 24. For example, evaporation-type materials such as Ba-Al or non-evaporation-type materials such as T-Zr-Al, Ti-Zr-V-Fe alloy are selectively used as the getter 24.

An exhaust through-hole 25 is formed in the outer wall portion 21*a* confronting the anode substrate 2 in the cover member 21. The exhaust tube 26 is hermetically sealed after an evacuation process to maintain the inside of the container 1 at higher vacuum degree.

A mounting hole 27 passing through the outer wall surface 21*a* of the cover member 21 is formed. A linear anode lead 28 penetrates the mounting hole 27 and hermetically fixed. In the anode lead 28, one side extends vertically outward a predetermined length from the outer wall surface 21*a* while the other extends vertically inward a predetermined length from inner wall surface 21*b*.

The anode lead 28 penetrating the mounting hole 27 is previously fixed using a crystallized glass. High-melting materials with good anti-insulation property which do not melt when the container 1 is hermetically sealed are used as crystallized glass.

In order to fix the anode lead 28 in the mounting hole 27, a method of heating and melting locally the glass in the mounting hole using a laser beam, with the anode lead 28 penetrating the mounting hole 27, and then fixing the outer peripheral surface of the anode lead 28 with the melt glass may be performed.

A contact member 29 for conductively contacting with the anode terminal 6*a* is attached to the front end of the anode lead 28. The contact member 29, as shown in FIGS. 2 and 3, is formed of two J-shaped resilient wires 29*a*.

The two wires 29*a* are securely fixed to the front end 28*a* of the anode lead 28, with the ends of the curved portions directing outward, by means of, for example, bonding agent or welding. With the cover member 21 securely fixed to the container 1, the curved portions of two wires 29*a* are pressed against the anode terminal 6*a* on the anode substrate 2 and are resiliently deformed.

In the configurations shown in FIGS. 2 and 3, two wires 29*a* are used to provide a stable contact pressure to the anode terminal 6. However, the number of wires and the shape should not be limited if the anode lead 28 can be brought in contact with the anode terminal 6*a* under a constant pressure.

The field emission type display device having the above-mentioned configuration is fabricated according to the following procedures. First, the display portion 7 formed of the fluorescent material layer 5 and the metal-backed layer 6 is coated on the inner surface of the anode substrate 2. The field emission element 8 is formed on the inner surface of the cathode substrate 3.

Next, the container 1 is assembled by hermetically sealing the anode substrate 2 and the cathode substrate 3. The cover member 21 is securely fixed on the outside of the container 1 so as to communicate with the container 1 via the exhaust hole 10. The anode lead 28 having its front end surface on which the contact member 29 is attached penetrates the mounting hole 27 and is hermetically fixed to the cover member 21.

In the anode lead 28 previously fixed to the cover member 21, the bent portions of the two wires 29 acting as the contact member 29 are pressed against the anode terminal 6*a* for electrical contact and are resiliently deformed. Thus the electrical conduction between the anode terminal 6*a* and the anode lead 28 is secured.

Next, the inside of the container 1 is maintained, for example, at a vacuum degree of $10^{-6}$ Torr through an evacuation process, while the exhaust tube 24 is hermetically sealed. Thereafter, the getter film 24*a* is formed on the wall surface of the getter room 23 defined by the cover member 21 by evaporating the getter 24. Then, in the oven heating step, the intermediate product is placed in an oven and heated at about 200° C.

The getter film 24*a* adsorbs gas released inside the container 1, thus maintaining the inside of the container 1, for example, at a high vacuum degree of 10–7 Torr. Thereafter, the intermediate product is driven and glowed in an aging process. Thus, a field emission type display device is completed.

To drive the field emission type display device, the anode lead 28 derived externally from the cover member 21 is inserted into the socket 30 with the lead 31 connecting to a drive circuit (not shown). Thus, the drive circuit (not shown) supplies a drive voltage to the anode terminal 6*a* of the metal-backed layer 6 via the lead 31.

Figure 4A:
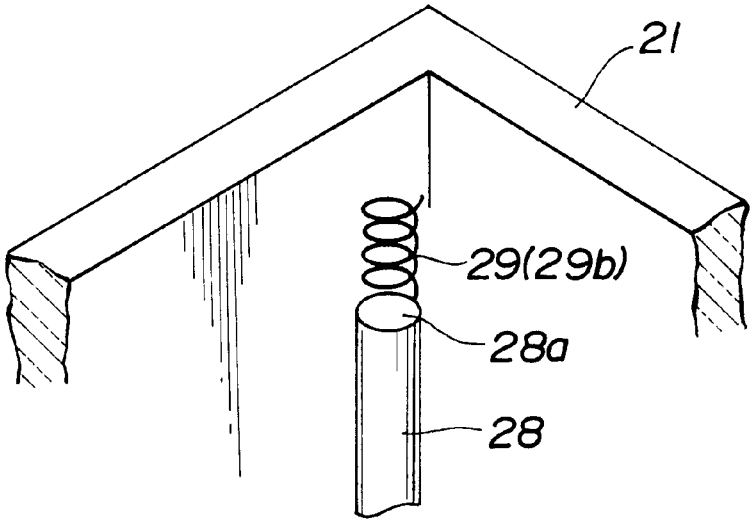
FIG. 4(*a*) is a diagram partially showing a modified contact member for a field emission type display device according to the present invention.
Figure 4B:
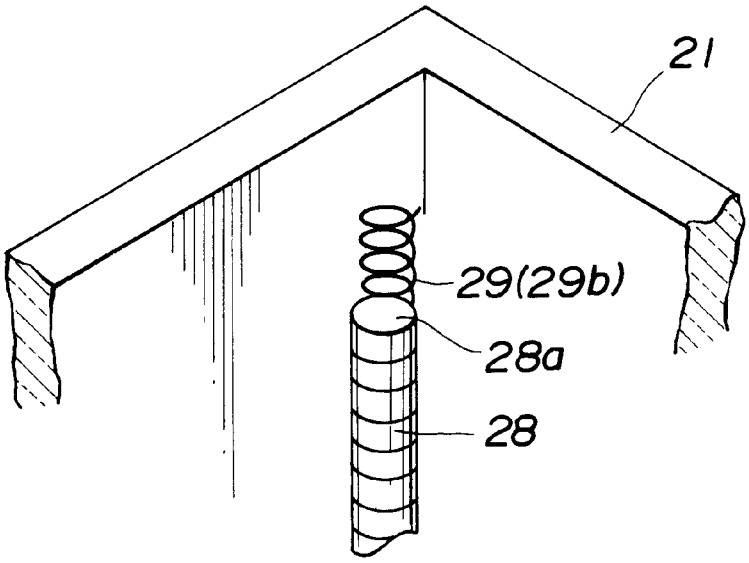
Figure 5:
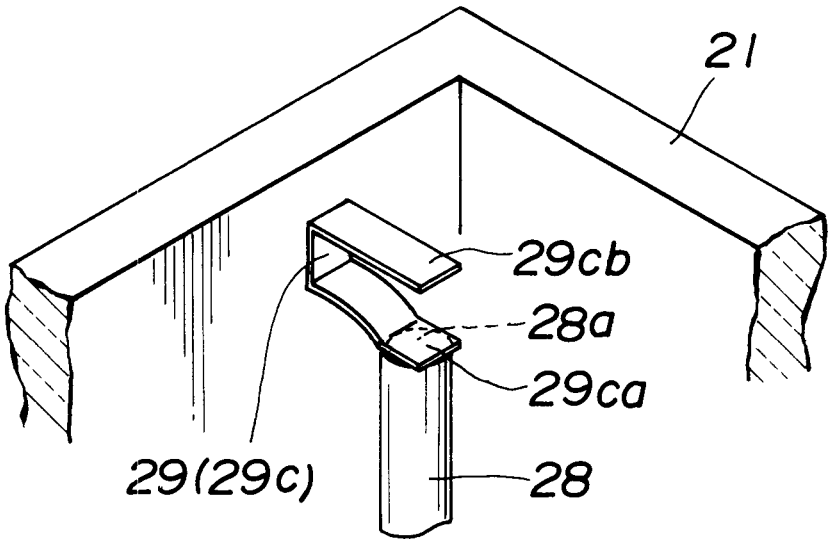
FIG. 5 is a diagram partially showing a modified contact member for a field emission type display device according to the present invention.

FIGS. 4 and 5 illustrate modifications of the contact member attached to the cover member of the FED according to the first embodiment.

Referring to FIGS. 4(*a*) and 4(*b*), the contact member 29 is formed of a coil spring 29*b*, in place of the wire 29*a* shown FIGS. 2 and 3. In FIG. 4(*a*), the coil spring 29*b* has one end securely fixed on the front end surface 28*a* of the anode lead 28 and the other end extending axially and outward from the front end surface 28*a*.

In FIG. 4(*b*), the anode lead 28 is partially inserted into the coil spring 29*b*. One end of the coil spring 29*b* is wound to the upper portion of the anode lead 28 while the other end extending axially and outward from the front end surface 28*a*.

To prevent the coil spring 29*b* from sliding down, the one end of the coil spring 29*b* can be securely fixed with an bonding agent or though welding, with the anode lead 28 partially inserted into the coil spring 29*b*.

In FIGS. 4(*a*) and 4(*b*), the coil spring 29*b* resiliently deforms such that the other end thereof contacts to the anode terminal 6*a* acting as an anode conductor of the metal-backed layer 6 and shrinks axially to the anode lead 28 when the cover member 21 is securely fixed on the container 1. This contact accomplishes the conduction between the anode terminal 6*a* and the anode lead 28.

Referring to FIG. 5, the contact member 29 is formed of a leaf spring 29*c*, in place of the wire 29*a* shown in FIGS. 2 and 3. The leaf spring 29*c* is bent in a U-shaped form. The open end 29*ca* is securely fixed to the front end 28*a* of the anode lead 28.

The leaf spring 29 of FIG. 5 resiliently deforms such that the other end 29*cb* is in area contact with the anode terminal 6*a* of the metal-backed layer 6 acting as an anode conductor when the cover member 21 is securely fixed on the container 1 and is depressed down toward the side of the anode lead. This contact allows an electrical conduction between the anode terminal 6*a* and the anode lead 28 to be provided.

The leaf spring 29 should not be limited to the U-shaped piece shown in FIG. 5 even if it is pressed against the anode terminal to accomplish electrical contact conduction between the anode terminal 6*a* and the anode lead 28.

Figure 6:
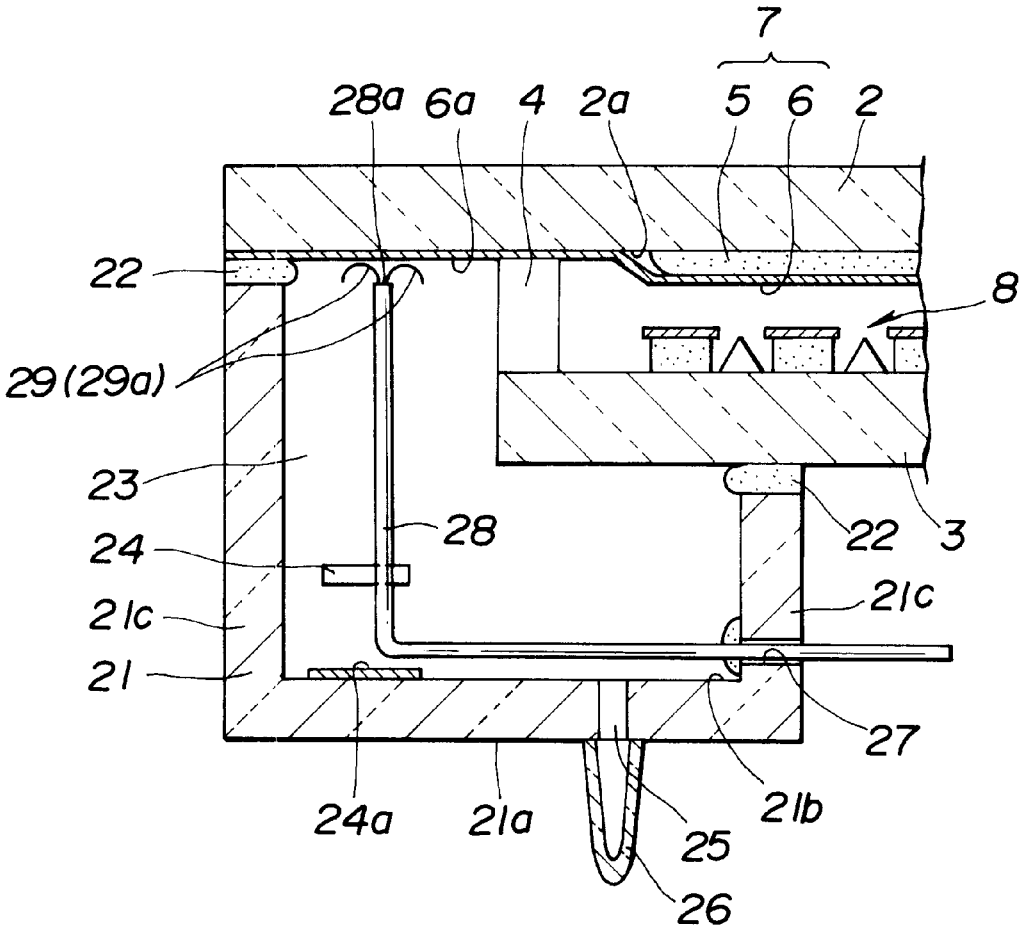
FIG. 6 is an enlarged cross-sectional view partially showing the structure in which the cover member is assembled to the field emission type display device, according to a second embodiment of the present invention.

FIG. 6 is a cross-sectional view partially showing an enlarged cover member according to the second embodiment of the present invention. Like numerals represent the same elements as those in the first embodiment.

The second embodiments corresponds to a modification of the configuration shown In FIG. 3. The second embodiment differs from the first embodiment in that the anode lead has a different shape and mounted in a different way. In the second embodiment; the mounting hole 27 penetrating the anode lead 28 is formed in the side wall 21*c* of the cover member 21 positioned on the side of the cathode substrate 2.

In FIG. 6 the anode lead 28 is illustrated to be bent at a right angle at a middle portion thereof. The wires 29*a* acting as the contact member 29 are bonded to the front end 28*a* of the bents anode lead 28. When the cover member 21 is securely fixed to the container 1, the anode lead 28 is brought into electrical cantact with anode terminal 6*a* through the curved portions of the wires 29*a* acting as the contact member 29.

In the second embodiment, the coil springs 29*b* shown in FIGS. 4(*a*) and 4(*b*) or the leaf spring 29*c* shown in FIG. 5 may be used as the contact member 29 attached on the front end of the anode lead 28, in place of the wire 29*a*.

Figure 7A:
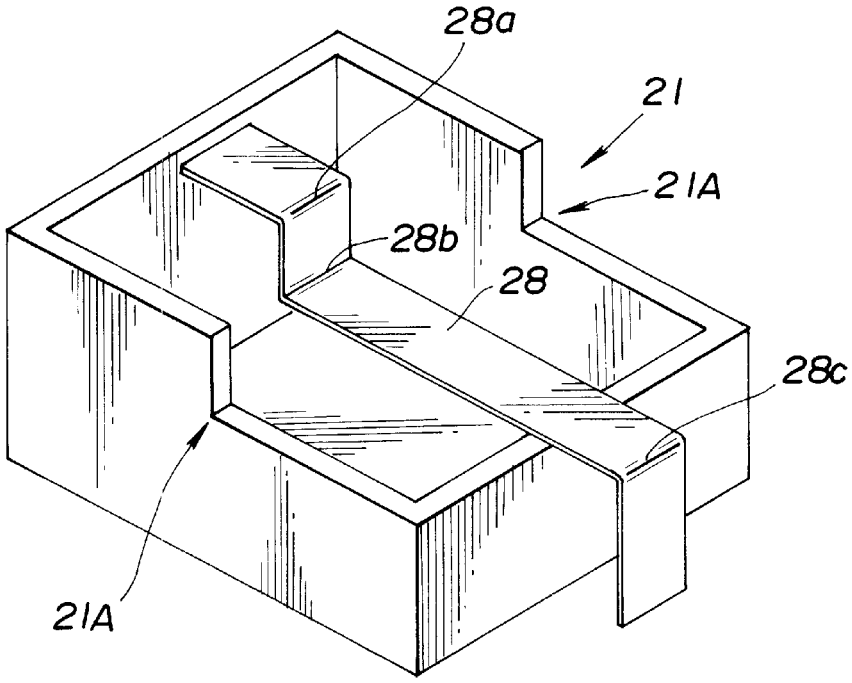
FIG. 7(*a*) is a perspective view showing a cover member to be assembled to a field emission type display device according a third embodiment of the present invention.
Figure 7B:
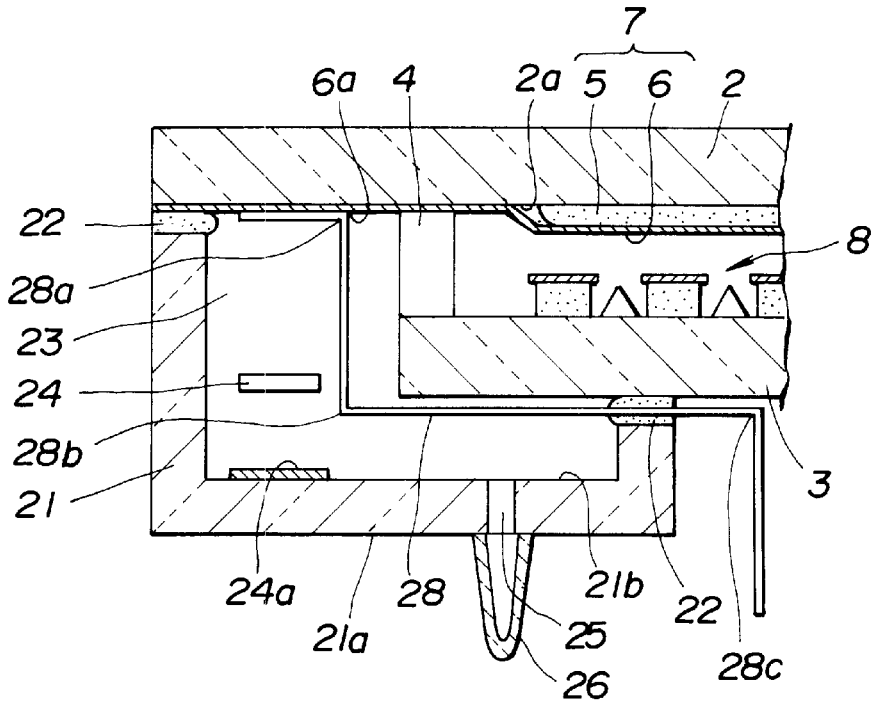

FIG. 7(*a*) is a perspective view of the cover member according to the third embodiment of the present invention while FIG. 7(*b*) is a cross-sectional view partially showing an enlarged getter room according to the third embodiment of the present invention.

Next, in the third embodiment, the anode lead 28 is formed of a strip-shaped leaf spring having the function of the contact member described above. The anode lead 28 formed of the leaf spring member has three fold portions 28*a*, 28*b*, and 28*c* respectively in the front end portion, the middle portion, and the rear portion. The anode lead 28 is folded at a certain position of one end portion at a right angle. The inner portion is folded at a right angle so as to be in parallel to the one end portion. The other end portion is folded at a right angle so as to be perpendicular to one end portion. That is, the anode lead 28 is bent so as to have two portions including a front end portion and a rear portion, which both extend at right angles from the middle portion;

When the cover member 21 is securely fixed to the container 1, the rear portion of the anode lead 28 is derived out from the cover member 21 through the bonding agent 22 so as to extend along the outer surface of the cathode substrate 3, while the front end portion of the anode lead 28 is in area contact with the anode terminal 6*a*.

Figure 8:
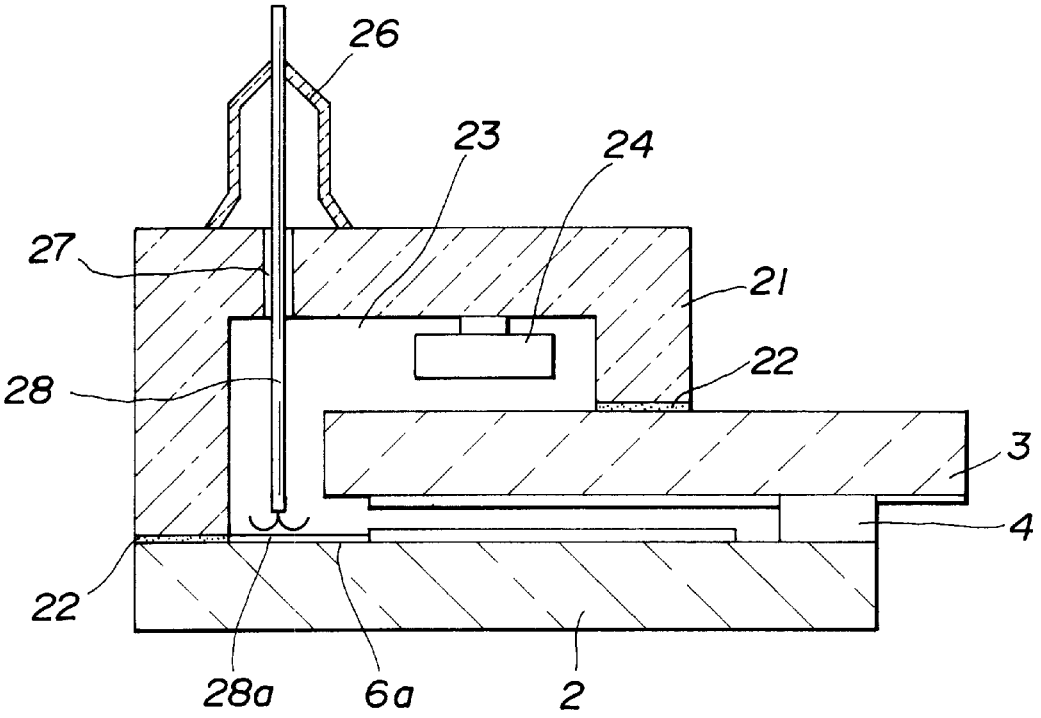
FIG. 8 is an enlarged side cross-sectional view partially showing the structure in which the cover member is assembled to the field emission type display device.
Figure 9A:
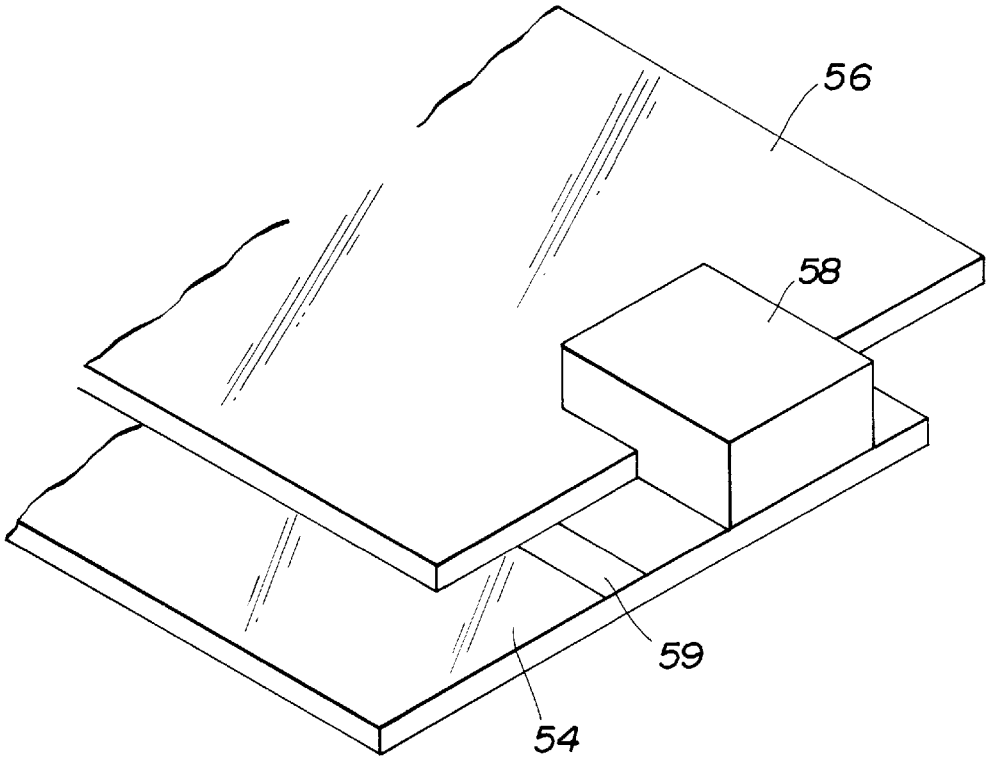
FIG. 9(*a*) is an enlarged perspective view partially showing the external appearance of a container for a conventional field emission type display device.
Figure 9B:
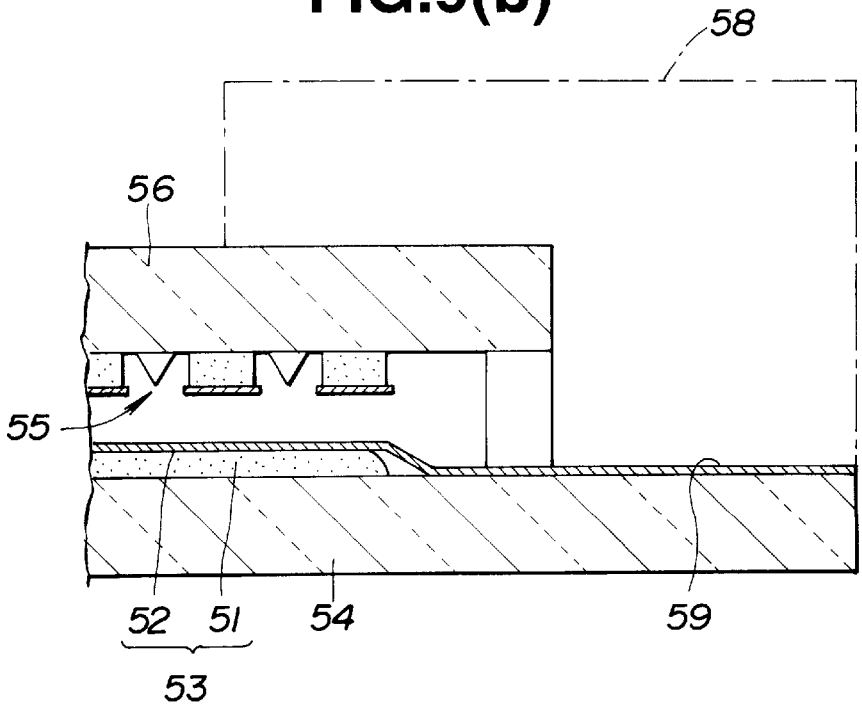

FIG. 8 is a side cross-sectional view partially showing a field emission type display device according to another embodiment of the present invention. Like numerals represent the same elements as those shown in FIG. 3.

In this embodiment, the anode lead 28 is supported by the exhaust tube 26 hermetically sealed after the container has been evaluated in vacuum. The anode lead 28 extends toward the surface of the anode substrate 2 through the exhaust tube 26. The contact member 28*a* is attached on the lower end of the anode lead 28 and is in contact with the anode terminal 6*a* of the metal-backed layer 6 formed on the surface of the anode substrate 2.

According to the embodiments 1 and 2, since the anode lead 28 for accomplishing electrical contact to the anode terminal 6*a* on the anode substrate 2 is previously fixed on the cover member 21 forming the getter room 23 with a part of the container 1, it can be treated as an integral component.

The anode wiring acting as the linear or striplike anode lead 28 extending from the flat anode terminal 6*a* in close contact with the anode substrate 2 is externally derived from the outer wall 21*a* of the cover member 21. Hence, unlike the conventional connection way, the linear anode lead 28, for example, can be electrically connected easily to the drive circuit (not shown) merely by inserting it into the socket 30 shown in FIG. 3.

Since the linear or striplike anode lead 28 is derived out from the outer wall 21*a* of the cover member 21, the anode lead 28 of larger diameter or wider line width can facilitate the handling of the anode lead, thus providing easier connection.

According to the second embodiment, since the anode lead 28 is hermetically fixed with the rear portion extending inward along the surface of the cathode substrate 3, it does not occupy the space so as increase the thickness of the container 21. Moreover, the anode wiring connection can be provided without disturbing the exhaust tube 26.

According to the third embodiment, the anode lead 28 fixed on the cover member 21 is formed of a leaf spring member, so that the mounting hole 27 in the cover member 21 can be omitted. Hence using a single component, the end portion can be brought in electrical contact with the anode terminal 6*a* while the anode wiring is led out to the outside of the container 1.

To assemble the container 1 in the FED manufacturing process, the oven heating step of sealing the anode substrate 2 and the cathode substrate 3 spaced by the side part 4 together is essential. Hence, the wiring derived from the anode terminal 6*a* to the outside of the container 1 can be accomplished on batch basis by fixing the cover member 21 to the container 1 in the oven heating process. Fixing the anode lead 28 to the cover member 21 does not lead to largely increased steps. Particularly, according to the third embodiment, the anode lead 28 is fixed at the same time in the step of fixing the cover member 21 to the container 1.

In the field emission type display device with the above-mentioned configuration, since a part of the metal-backed layer 6 acting as the anode terminal 6*a* is derived from the end portion of the anode substrate 2 through the exhaust tube 10, the wiring can be derived from the anode without passing through the sealed portion of the container 1. Hence, the number of contact points where the side portion 4 contacts with the low-melting glass with a low dielectric strength can be reduced. This improves the safety in the anode wiring connection. Moreover, since the sealing portion is not broken, as seen in prior art, even when a high voltage is applied to the anode, the dielectric strength characteristic can be improved.

In the embodiments shown in FIGS. 2 to 7, steps 21A each having a depth (t1+t2) (where t1 is the thickness of the cathode substrate 3 and t2 is the thickness of the side wall portion 4) are formed in the middle portions of the side walls 21*a* of the cover means 21. A boxlike cover member with no steps 21A in the side wall portion 21*a* can be used by inserting a U-shaped spacer member having a thickness of (t1+t2) (where t1 is the thickness of the cathode substrate 3 and t2 is the thickness of the side member 4) between the cover member 21 and the end surface of the end portion of the anode substrate 2.

In the field emission type display device with the above-mentioned configuration, the fluorescent material layers 5 are coated on the inner surface of the anode substrate 2. The metal-backed layer 6 is coated on the fluorescent material layer 5. Part of the metal-backed layer 6 acting as the anode terminal 6*a* is derived to the end portion of the anode substrate 2. In contrast, the field emission type display device can be fabricated by coating an anode conductor on the inner surface of the anode substrate 2, deriving part of the anode conductor acting as the anode terminal 6*a* to the end of the anode substrate 2, and then coating the fluorescent material layer 5 on the anode conductor 2.

In that case, the cathode electrodes 11 and the gate electrodes 13 in the field emission element 8 are arranged in a matrix pattern. Electrons are selectively emitted from the intersections between the cathode electrodes 11 and the gate electrodes 13 so that the fluorescent material layers 5 confronting the intersections can be selectively glowed.

As understood clearly from the above description, the field emission type display device according to the present invention has the following advantages. That is, the anode lead for ensuring an electrical contact with the anode terminal on the side of the anode substrate can be handled as an integral component because it has the construction attached to the cover member which defines a getter room together with the container.

Unlike the conventional way, the electrical connection between the anode and the drive circuit can be easily ensured because the anode wiring is derived as an anode lead extending outward from the wall surface of the cover member, from the flat anode terminal in close contact with the anode substrate.

The anode wiring can be provided as an the anode lead extending outward from the container by securely fixing the cover member with the outwardly extending anode lead; to the container in the oven heating step in the FED manufacturing process.

Since the anode terminal forming part of an anode conductor is lead to the end portion of the anode substrate through the exhaust hole, the wiring can be derived from the sealed portion of a low melting glass with low dielectric strength in the container, without passing through the sealed portion of the container. As a result, the safety can be improved upon node wiring connection. Even when a high voltage is applied to the anode, there is no possibility that the sealed portion experiences dielectric breakdown, which has been often observed. Hence, the dielectric strength of the sealed portion can be improved.

Since the anode lead hermetically fixed to the cover member is formed of a leaf spring member, leading the anode wiring out of the container, with the front end being electrically in contact with to the anode terminal, can be practiced with a single component.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A field emission type display device, comprising:

an anode substrate including display portions each formed of a fluorescence material layer and an anode conductor;

a cathode substrate having an inner surface on which electron emission elements are formed so as to confront said display portions of said anode substrate;

wherein a container is formed by spacing said anode substrate and said cathode substrate a predetermined distance from each other by a peripheral wall portion hermetically sealed to said cathode substrate and said anode substrate;

said container having an exhaust hole formed in a part of said peripheral wall portion;

a cover member securely mounted to the outside of said container so as to form a getter room communicating with said exhaust hole; and an anode lead in electrical contact with an anode terminal portion of said anode conductor at an end portion of said anode substrate which extends from the container through the exhaust hole, said anode lead passing through a sealed portion of said cover member.

2. The field emission type display device as defined in claim 1, wherein a front end of said anode lead is configured to have a resilient characteristic and to press said anode terminal.

3. The field emission type display device as defined in claim 1, wherein said anode lead comprises a leaf spring member and said sealed portion seals said cathode substrate and said cover member together.

4. The field emission type display device as defined in claim 1, wherein said anode lead is configured to extend from said cover member through a sealed exhaust tube attached on said cover member forming said sealed portion.

* * * * *

UNITED STATES PATENT AND TRADEMARK OFFICE

CERTIFICATE OF CORRECTION

PATENT NO. : 5,965,978

DATED : OCTOBER 12, 1999

INVENTOR(S) : TAKAO KISHINO, ET AL.

It is certified that error appears in the above-identified patent and that said Letters Patent is hereby corrected as shown below:

Title page showing the illustrative figure should be deleted and substitute the attached title page.

Figures 3, 6 and 8, should be deleted to appear as per attached.

Signed and Sealed this

Seventh Day of November, 2000

*Attest:*

Q. TODD DICKINSON

*Attesting Officer*

*Director of Patents and Trademarks*

United States Patent [19]

Kishino et al.

[11] Patent Number: 5,965,978

[45] Date of Patent: Oct. 12, 1999

[54] FIELD EMISSION DISPLAY DEVICE WITH IMPROVED DIELECTRIC BREAKDOWN CHARACTERISTIC

[75] Inventors: Takao Kishino; Haruhisa Hirakawa; Kenichi Furumata, all of Mobara, Japan

[73] Assignee: Futaba Denshi Kogyo K.K., Mobara, Japan

[21] Appl. No.: 08/893,187

[22] Filed: Jul. 15, 1997

[30] Foreign Application Priority Data

Jul. 16, 1996 [JP] Japan ..... 8-186184

[51] Int. Cl.[6] ..... H01J 63/04

[52] U.S. Cl. ..... 313/496; 313/493; 313/495

[58] Field of Search ..... 313/493, 495, 313/496, 318.01, 318.12; 439/824

[56] References Cited

U.S. PATENT DOCUMENTS

| | | | |
|---|---|---|---|
| 4,149,105 | 4/1979 | Hirooka et al. | 313/496 |
| 4,767,965 | 8/1988 | Yamano et al. | 313/493 |
| 5,463,276 | 10/1995 | Kawasaki et al. | 313/496 |
| 5,621,272 | 4/1997 | Levine et al. | 313/422 |
| 5,635,795 | 6/1997 | Itoh et al. | 313/496 |
| 5,734,224 | 3/1998 | Tagawa et al. | 313/495 |

*Primary Examiner*—Vip Patel
*Assistant Examiner*—Matthew J. Gerike
*Attorney, Agent, or Firm*—Oblon, Spivak, McClelland, Maier & Neustadt, P.C.

[57] ABSTRACT

A field emission type display device including a container formed of an anode substrate, a cathode substrate and side wall portions, and a cover member mounted at the container to form a getter room. An anode lead is securely fixed on the cover member so as to be derived outward from the outer wall confronting the anode substrate. Two wires are attached to the front end of the anode lead. When the cover member is mounted on the container, the curved portions of the two wires is pressed against the anode terminal formed on the anode substrate extended to the end of the anode substrate to secure electric conduction between the anode terminal and the anode lead. This structure provides easy-to-use anode leads which can be simply derived as electrodes.

4 Claims, 9 Drawing Sheets

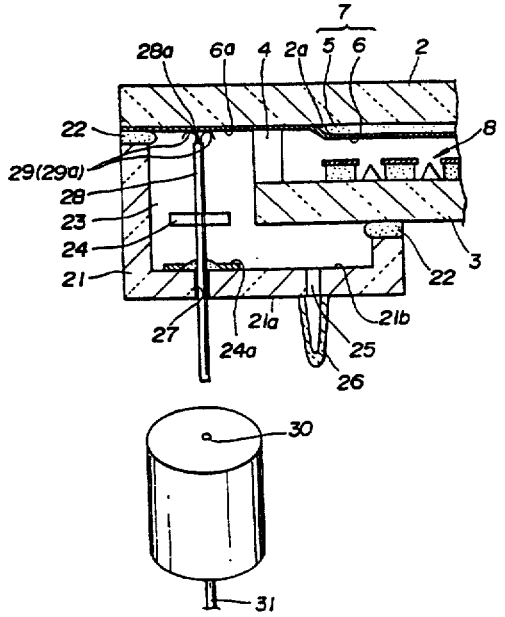

UNITED STATES PATENT AND TRADEMARK OFFICE

CERTIFICATE OF CORRECTION

PATENT NO. : 5,965,978

DATED : OCTOBER 12, 1999

INVENTOR(S) : TAKAO KISHINO, ET AL.

It is certified that error appears in the above-identified patent and that said Letters Patent is hereby corrected as shown below:

FIG.3

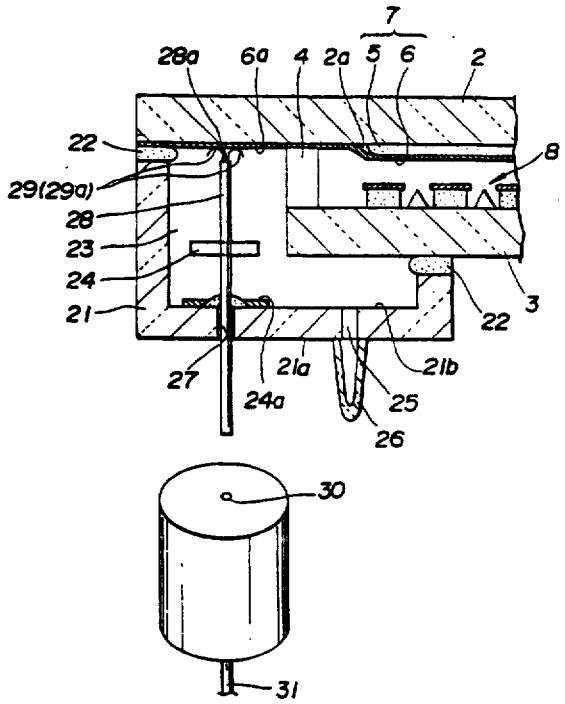

FIG.6

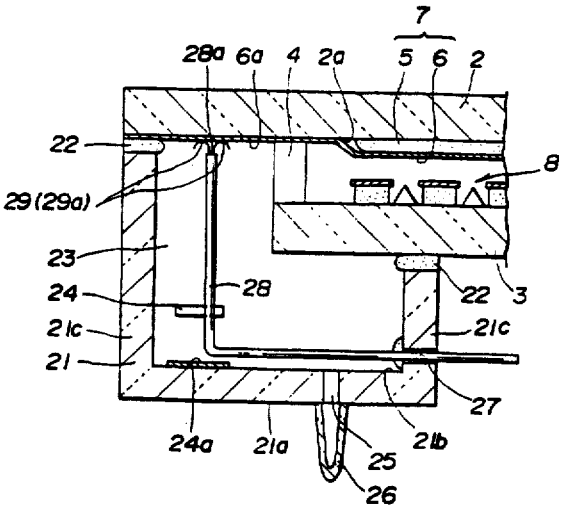

UNITED STATES PATENT AND TRADEMARK OFFICE

CERTIFICATE OF CORRECTION

PATENT NO. : 5,965,978

DATED : OCTOBER 12, 1999

INVENTOR(S) : TAKAO KISHINO, ET AL.

It is certified that error appears in the above-identified patent and that said Letters Patent is hereby corrected as shown below:

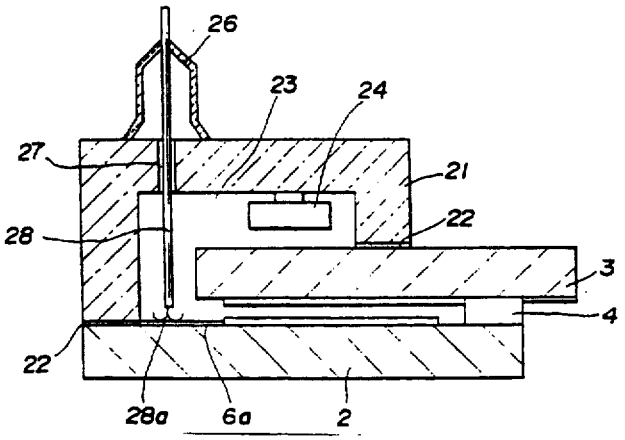

FIG.8